US005947030A

United States Patent [19]

Spieldiener et al.

[11] Patent Number: 5,947,030

[45] Date of Patent: Sep. 7, 1999

[54] AMUSEMENT DEVICE IN THE FORM OF A ROLLER COASTER, A MONORAIL OR THE LIKE

[76] Inventors: Robert Spieldiener, Joseph-Rheinberger-Str. 18, FL-9490 Vaduz; Reinhold Spieldiener, Aussichtsstr. 23, CH-8704 Herrliberg; Patrick Spieldiener, Erlenstr. 134, CH-8832 Wollerau; Alfons Saiko, Speerstr. 26a, CH-8942 Oberrieden, all of Switzerland

[21] Appl. No.: 09/101,995

[22] PCT Filed: Sep. 2, 1997

[86] PCT No.: PCT/EP97/04763

§ 371 Date: Jul. 16, 1998

§ 102(e) Date: Jul. 16, 1998

[87] PCT Pub. No.: WO98/22192

PCT Pub. Date: May 28, 1998

[30] Foreign Application Priority Data

Nov. 21, 1996 [DE] Germany ..... 296 20 284 U

[51] Int. Cl.[6] ..... B61K 7/00

[52] U.S. Cl. ..... 104/250; 104/249; 104/252; 188/82.1

[58] Field of Search ..... 104/53, 118, 249, 104/250, 251, 252; 188/82.1, 82.3, 82.4, 82.77, 82.8

[56] References Cited

U.S. PATENT DOCUMENTS 1,613,118 1/1927 Miller .

FOREIGN PATENT DOCUMENTS 0 575 702 A1 12/1993 European Pat. Off. .
0 754 480 A1 1/1997 European Pat. Off. .
25 40 547 3/1977 Germany .
94 18 497 2/1995 Germany .

*Primary Examiner*—Mark T. Le
*Attorney, Agent, or Firm*—McGlew and Tuttle, P.C.

[57] ABSTRACT

A recoil blocking device for vehicles (1) for roller-coasters, monorails or the like. To avoid the ratchet noises occurring in the case of prior-art ratchet-type blocking mechanisms of such recoil blocking devices, the present invention provides a catch drive (21), which is designed as an eddy current drive and spaces the catch (2) from the countercatch (5) when the vehicle (1) is moving forward and allows the catch (2) to engage the countercatch (5) when the vehicle (1) is standing or moving backward. The catch (2) is mounted rotatably at the vehicle, whereas the countercatch (5) is arranged stationarily in the form of a toothed rack in the area of the rail arrangement (4) of an uphill section.

18 Claims, 2 Drawing Sheets

1
2
3
4
5
6
7
8
9
10
11
12
13
14
17
18
19
20
21,22
N
S 20
1
2
3
8
15
17
6
7
5
11
12
16
9
10
18
4
21,22
N
S

AMUSEMENT DEVICE IN THE FORM OF A ROLLER COASTER, A MONORAIL OR THE LIKE

FIELD OF THE INVENTION

The present invention pertains to an amusement facility in the form of a roller-coaster, monorail or the like, in which at least one vehicle guided on rails is preferably movable by its own momentum over uphill and downhill sections, wherein a recoil blocking device, which usually comprises at least one catch mounted rotatably at the vehicle and a countercatch designed as a toothed rack and extends stationarily along the rail in the plane of movement of the catch, is provided at least in the area of uphill sections. The teeth are designed such that the catch slides dragging over the toothed rack during forward travel and it lockingly engages the toothed rack during stopping or reverse movement of the vehicle, thus blocking the movement of the vehicle.

BACKGROUND OF THE INVENTION

Such arrangements, quite generally called recoil blocking devices, are specified as obligatory devices for roller-coasters, monorails or the like. They are to come into action when a vehicle moving upward is unable to clear the uphill section for whatever reason and seeks to stop travel backward after stopping. The same device is advantageously used when a vehicle that has come to a standstill must be prevented from moving accidentally backward in the area of a railroad station.

In prior-art recoil blocking devices, the catches are pressed by means of a spring against the toothed rack in a rotationally engaged manner. It shall thus be achieved that the catch will automatically engage the teeth as a consequence of the spring torque if the vehicle should move backward. The drawback of such arrangements is that when an uphill section has been cleared, unpleasant ratchet noises are generated by the fact that the nose of the catch continually comes into contact with the teeth of the toothed rack and is temporarily deflected by same against the spring action.

This drawback is eliminated by the teaching of DE-OS 25 40 547, in which electromagnetic means keep the catch disengaged from the toothed rack depending on a speedometer. However, this suggestion presupposes stationary guides, which bring the catches into contact with the electromagnetic means during the travel of the vehicle past them.

SUMMARY AND OBJECTS OF THE INVENTION

The primary object of the present invention is to show a better recoil blocking device, which requires no guides and does not generate ratchet noise.

According to the invention, an amusement facility in the form of a roller-coaster, monorail or the like is provided in which at least one vehicle is guided on a said rail or the like and can be moved over uphill and downhill sections. A recoil blocking device with at least one rotatably mounted catch and a countercatch designed as a toothed rack are provided at least in the area of uphill sections. The catch lockingly engages the countercatch blocking the movement of the vehicle under an electromagnetic effect during stopping or reverse movement of the vehicle. The recoil blocking device has a catch drive, which is preferably designed as an eddy current drive. The catch drive removes the catch from the countercatch when the vehicle is moving forward and allows the catch to engage when the vehicle has stopped or is moving backward.

The recoil blocking device according to the present invention operates just as reliably as the prior-art design and also avoids the unpleasant ratchet noises. A catch drive, which removes the catch from the countercatch and lifts it off in a noise-reducing manner during forward travel, is provided for this purpose. During the stopping or reverse travel of the vehicle, the catch drive allows the catch to engage again and to assume its blocking function.

The catch drive may have any desired design and different designs. An eddy current drive is provided in the preferred embodiment. This drive has the advantage that it does not need any external energy, such as battery current or the like, but it takes its energy from the movement of the vehicle. In addition, the eddy current drive is a self-controlling drive and comes automatically into operation. It is especially reliable and trouble-free as a result.

In a preferred exemplary embodiment, this principle of operation is embodied by a strip-like sword being stationarily arranged in parallel to the toothed rack as part of an eddy current drive, which sword is made of an electrically conductive material, e.g., copper, aluminum or the like, and by the catch having a projection provided with magnets, whose magnets are guided movably at a short distance from the sword.

When a vehicle thus equipped is moved on a section where the toothed rack and the sword of the eddy current drive are located, a magnetic field, which generates a decelerating torque acting on the catch opposite its forward movement, is formed due to the relative movement between the magnets of the catch and of the catch projection, on the one hand, and the sword, on the other hand. This torque causes the catch with its nose to be kept out of engagement with the toothed rack. The opening rotary movement of the catch can be exercised against its force of gravity or against the action of a spring. If the vehicle comes to a standstill, the magnetic field disappears and the catch can fall off under its own weight or under the action of a spring and engage the toothed rack. This movement always takes place only when the vehicle should move backward, because a magnetic field generating a torque in the opposite direction is generated, and this torque contributes to firmly pressing the catch into engagement with the tooth.

It is recommended that the projection of the catch be designed as a bent segment, on the circumference of which, which is preferably circular, the magnets are located at spaced locations from one another directed radially in relation to the axis of rotation of the catch. It is apparent that the circular circumference has its center in the axis of rotation of the catch. It is recommended that the magnets be arranged alternatingly with their south and north poles. The segment may be connected, especially screwed, to the catch as a separate component.

However, the present invention also comprises the reverse arrangement of the components forming the eddy current drive, according to which one or more catches with the magnets are mounted rotatably in the area of the rail and the sword with the toothed rack is arranged at the vehicle.

It is recognized from this that the present invention is not limited to the exemplary embodiment described in the specification, but also covers all the variants that arise for the person skilled in the art in the knowledge of the disclosure according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
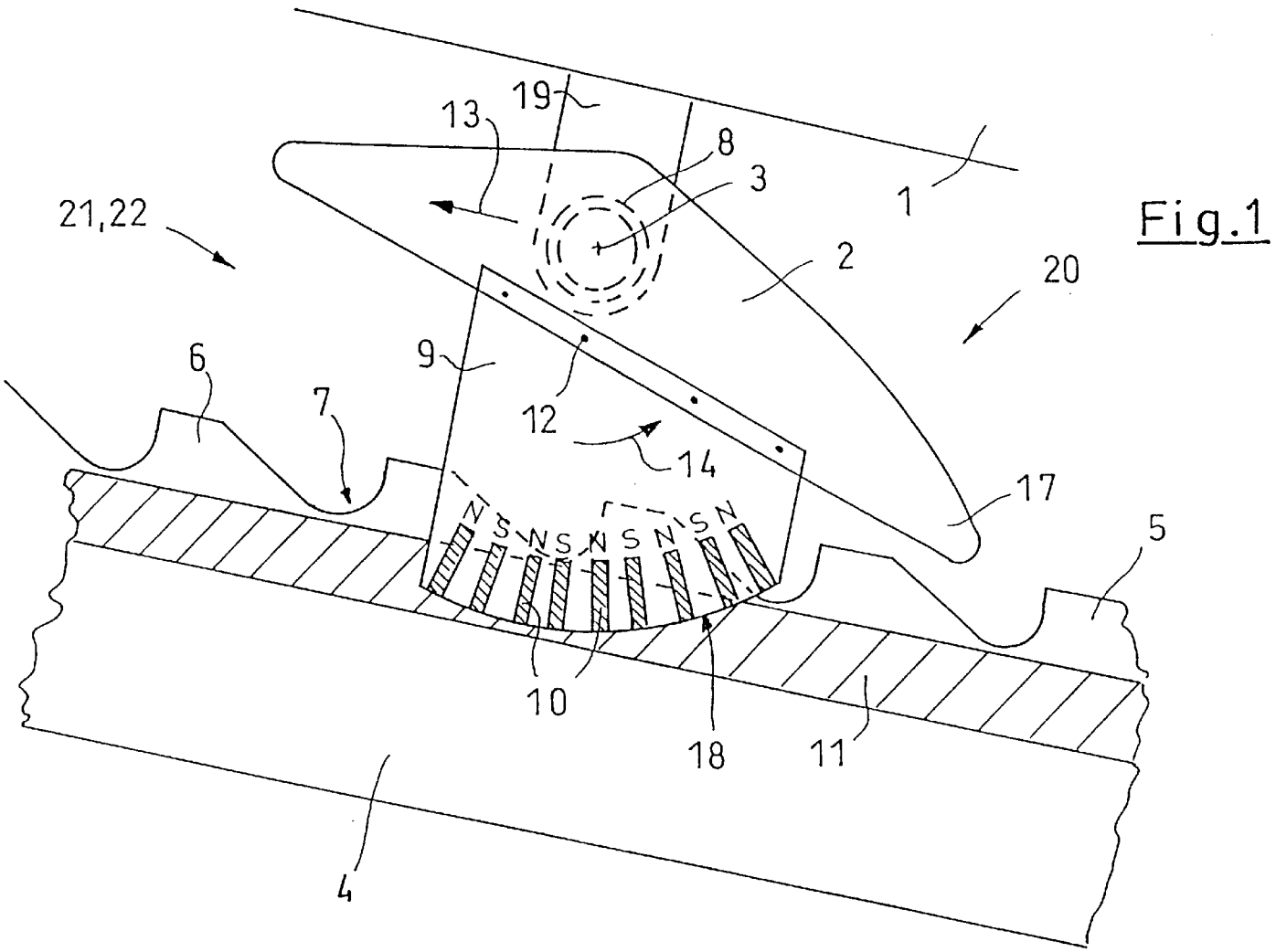
FIG. 1 is a schematic view of a catch-type recoil blocking device during the uphill movement of a vehicle along a rail line.

Referring to the drawings in particular, the exemplary embodiment according to FIG. 1 is based on a prior-art arrangement of a recoil blocking device 20 at a vehicle 1 of an amusement facility, such as a roller-coaster, monorail or the like. The vehicle is therefore not shown completely with its wheels and the rails. Reference number 1 symbolically represents a vehicle which forms, via a bearing 19, a catch axis of rotation 3, at which a catch 2 is rotatably mounted. This catch 2 cooperates with a countercatch, which is designed as a toothed rack 5 and extends in the area of a rail arrangement 4, along which the vehicle 1 can be moved in the usual manner. FIG. 1 also shows that the first rail arrangement 4 is an uphill section rising to the left.

It is common practice in prior-art recoil blocking devices that the catch 2 with its catch nose 17 ratchets along the teeth 6 of the toothed rack 5 when the vehicle 1 is moving along an uphill section. The unpleasant noise generated by this ratcheting shall be avoided by the present invention.

A catch drive 21, which moves the catch 2 away from the toothed rack 5 during normal operation during forward travel and prevents ratchet noises as a result, is provided for this purpose. However, if the vehicle 1 comes to a standstill in the area of the recoil blocking device 20 or even moves backward in a potentially dangerous manner, the catch drive 21 releases the catch 2 and allows it to engage the toothed rack 5 in a locking manner or it brings it actively into locking engagement.

The catch drive 21 may have various designs and have, e.g., a motor operator or magnetic drive, which receives the current from a battery or a dynamo. In the preferred exemplary embodiment, the catch drive 21 is designed as an eddy current drive 22, which operates automatically as a function of the movement of the vehicle and requires no separate control or additional external energy.

The eddy current drive 22 preferably actuates the movable catch 2 in relation to the stationary toothed rack 5. However, the drive association and the kinematics may also be reversed.

A segment 9 is arranged at the catch 2, and a plurality of magnets 10 are located on the bent and preferably circular circumference 18 of the segment, and the center of the segment is located in the axis of rotation 3 of the catch. The magnets 10 are arranged in the arc and at laterally spaced locations from one another. They are spaced from the axis of rotation 3 of the catch and are directed with their longitudinal axis radially to the axis of rotation 3 of the catch. The magnets 10 alternate with one another concerning the location of their north and south poles. The segment 9 is screwed or connected in another way to the catch 2 via the connection means 12.

A strip-like rail 11, which is called a sword and consists of an electrically conductive material, e.g., copper, aluminum or the like or has a lining consisting of such a material, is located next to the toothed rack 5 at a closely spaced location from the range of movement of the magnets 10.

It is assumed in the example according to FIG. 1 that the rail arrangement 4 is located in an uphill section rising to the left. The vehicle 1 correspondingly performs an upward movement in the direction of arrow 13.

Decelerating magnetic forces, which lead to an opening torque according to the arrow 14 at the catch 2, are generated by the eddy current field due to the relative movement between the magnets 10 and the sword 11. This torque 14 acts against the force of gravity of the catch or against the action of the torsion spring 8 and causes the catch 2 to remain disengaged from the toothed rack 5 during the upward movement of the vehicle 1 according to the arrow 13.

However, as soon as the vehicle 1 comes to a standstill or even seeks to move backward, the magnetic forces are eliminated, which causes the weight of the catch 2 itself or the action of the torsion spring 8 to allow the nose 17 of the catch to enter the tooth space 11 of the toothed rack 5. One position of the catch 2 is shown in FIG. 2.

Figure 2:
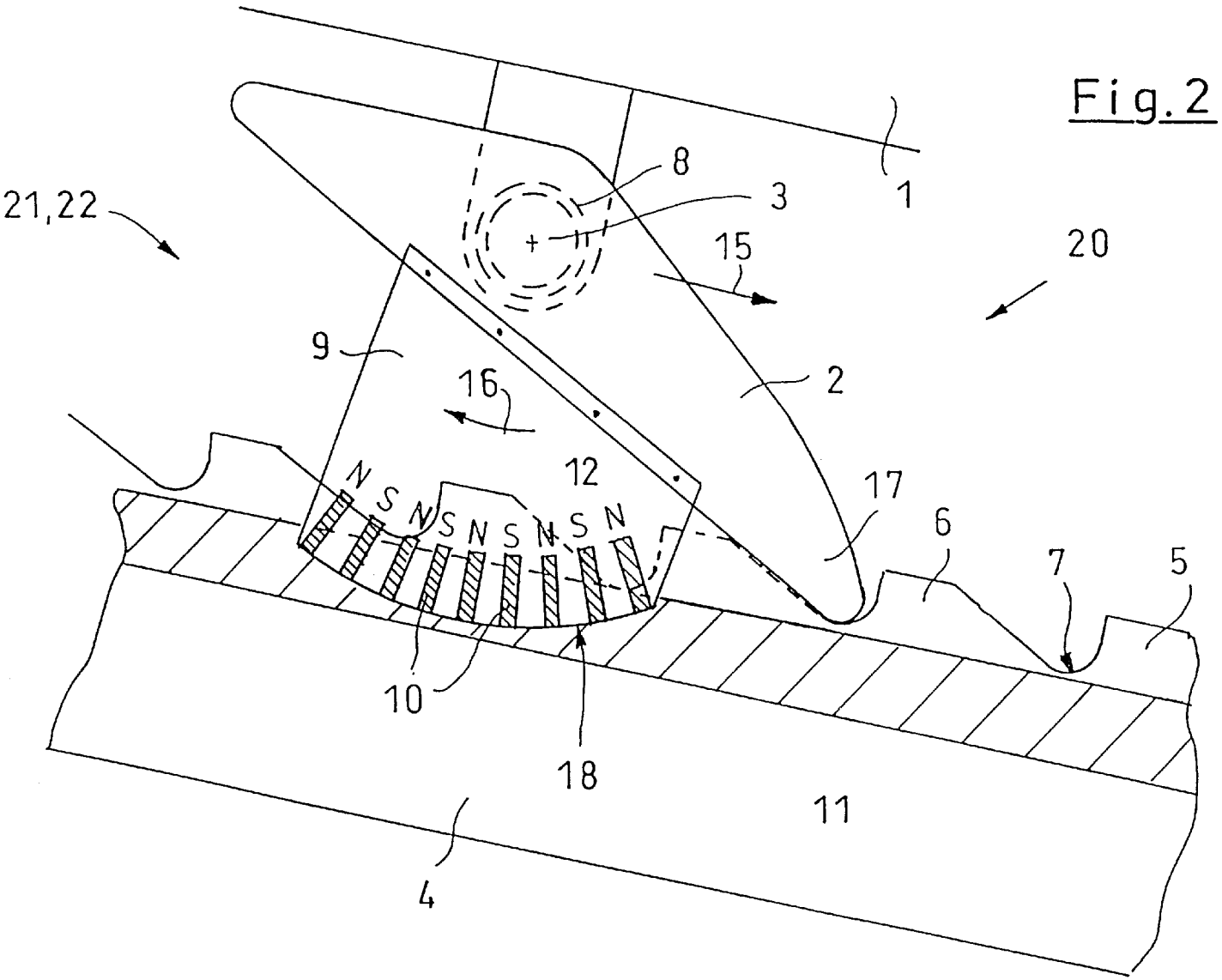
FIG. 2 is a schematic view of the catch-type recoil blocking device according to FIG. 1 in the engaged position during downhill travel of the vehicle.

Should the vehicle 1 begin to move in the reverse direction according to arrow 15 in FIG. 2, magnetic forces are again generated between the magnets 10 and the sword 11, but they now lead to an opposite, closing torque according to arrow 16. This torque according to arrow 16 forces the nose 17 of the catch to engage the tooth space 7 and thus prevents the vehicle 1 from moving backward.

The present invention is not limited to the situation and arrangement shown in FIGS. 1 and 2.

For example, reversing the arrangement of the parts of the eddy current drive is conceivable. For example, the catch 2, of which there may be one or several, may be mounted stationarily and rotatably at the rail arrangement 4, whereas the toothed rack 5 and the sword 7 may be located at the vehicle 1. It is achieved with certainty in this case as well that the catch will not generate any ratchet noises during the normal travel of the vehicle 1 and that, conversely, the catch 2 will immediately engage the toothed rack 5 on stopping or backward travel of the vehicle.

It is also conceivable that the arrangement of the magnets 10 and the sword 11 be transposed in terms of their mode of action. The sword 11 may be provided, e.g., with a plurality of magnets arranged one behind the other, whose poles are likewise arranged alternatingly in relation to one another, whereas the segment 9 consists of a conductive material or is provided with such a material.

Therefore, the present invention is not limited to the exemplary embodiment shown, but it also covers all the variants that arise for the person skilled in the art. While a specific embodiment of the invention has been shown and described in detail to illustrate the application of the principles of the invention, it will be understood that the invention may be embodied otherwise without departing from such principles.

We claim:

1. An amusement facility, comprising:

a roller-coaster/monorail including at least one vehicle guided on a rail, said vehicle being movable over uphill and downhill sections on said rail;

a recoil blocking device with at least one rotatably mounted catch and with a toothed rack countercatch, said catch lockingly engaging said countercatch blocking movement of the vehicle during one of stopping and reverse movement of said vehicle, said recoil blocking device including a catch eddy current drive removing said catch from said countercatch under an electromagnetic effect when said vehicle is moving forward and said catch eddy current drive allowing said catch to engage when said vehicle has one of stopped and is moving backward.

2. The amusement facility in accordance with claim 1, wherein said countercatch is a stationary toothed rack;

said catch has a projection; and said catch eddy current drive includes an electrically conductive material strip-like sword stationarily arranged in parallel to said countercatch and magnets arranged at a closely spaced location from said sword, said magnets being provided on said projection.

3. The amusement facility in accordance with claim 2, wherein said projection is designed as an arc-shaped segment with a curved circumference, said magnets being arranged at laterally spaced locations along said curved circumference.

4. The amusement facility in accordance with claim 2, wherein said magnets are arranged in an arc and are directed radially with respect to a catch axis of rotation.

5. The amusement facility in accordance with claim 2, wherein said magnets are arranged with alternating poles.

6. The amusement facility in accordance with claim 3, wherein said segment is provided as a separate component connected to said catch.

7. The amusement facility in accordance with claim 6, wherein said segment is screwed to said catch.

8. The amusement facility in accordance with claim 1, wherein said countercatch is a toothed rack connected to said vehicle;

said catch has a projection mounted rotatably in said rail area; and said catch eddy current drive includes an electrically conductive material strip-like sword stationarily arranged in parallel to said countercatch and magnets arranged at a closely spaced location from said sword, said magnets being provided on said projection.

9. The amusement facility in accordance with claim 1, wherein:

one of said catch and said countercatch is mounted on one of said uphill sections.

10. A rail vehicle arrangement, comprising:

a vehicle;

a rail, said vehicle being guided on said rail and movable over rail uphill sections and rail downhill sections;

recoil blocking means on said vehicle and said rail, said recoil blocking means including at least one rotatably mounted catch and a toothed rack countercatch, said catch lockingly engaging said countercatch blocking movement of the vehicle during one of stopping and reverse movement of said vehicle, said recoil blocking device including catch eddy current drive means for removing said catch from said countercatch under an electromagnetic effect when said vehicle is moving forward and said catch eddy current drive means allowing said catch to engage when said vehicle has one of stopped and is moving backward.

11. The rail vehicle arrangement in accordance with claim 10, wherein:

said countercatch is a stationary toothed rack;

said catch has a projection; and said catch eddy current drive means includes an electrically conductive material strip stationarily arranged in parallel to said countercatch and magnets arranged at a closely spaced location from said strip, said magnets being provided on said projection.

12. The rail vehicle arrangement in accordance with claim 11, wherein said projection is designed as an arc-shaped segment with a circumference, said magnets being arranged at laterally spaced locations along said circumference.

13. The rail vehicle arrangement in accordance with claim 11, wherein said magnets are arranged in an arc and are directed radially with respect to a catch axis of rotation.

14. The rail vehicle arrangement in accordance with claim 11, wherein said magnets are arranged with alternating poles.

15. The rail vehicle arrangement in accordance with claim 12, wherein said segment is provided as a separate component connected to said catch.

16. The rail vehicle arrangement in accordance with claim 15, wherein said segment is screwed to said catch.

17. The rail vehicle arrangement in accordance with claim 10, wherein said countercatch is a toothed rack connected to said vehicle;

said catch has a projection mounted rotatably in said rail area; and said catch eddy current drive includes an electrically conductive material strip-like sword stationarily arranged in parallel to said countercatch and magnets arranged at a closely spaced location from said sword, said magnets being provided on said projection.

18. An arrangement in accordance with claim 10, wherein:

one of said catch and said countercatch is mounted on one of said uphill sections.

* * * * *